US006614159B2

(12) United States Patent
Funakura

(10) Patent No.: US 6,614,159 B2
(45) Date of Patent: Sep. 2, 2003

(54) ELECTRON GUN FOR CATHODE RAY TUBE

(75) Inventor: Tetsuo Funakura, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/120,547

(22) Filed: Apr. 12, 2002

(65) Prior Publication Data

US 2002/0180334 A1 Dec. 5, 2002

(30) Foreign Application Priority Data

Jun. 1, 2001 (JP) ..... 2001-166208

(51) Int. Cl.[7] ..... H01J 29/50

(52) U.S. Cl. ..... 313/447; 313/414; 315/3; 315/382

(58) Field of Search ..... 315/3, 59, 71, 315/281, 282; 313/441–446, 447, 414, 417, 457

(56) References Cited

U.S. PATENT DOCUMENTS 4,853,584 A * 8/1989 Inoue ..... 313/447
5,077,497 A * 12/1991 Kamohara et al. ..... 315/3
6,353,281 B2 * 3/2002 Sugiyama et al. ..... 313/447
6,407,491 B1 * 6/2002 Noguchi et al. ..... 313/414

FOREIGN PATENT DOCUMENTS

JP 1-83251 U 6/1989 ..... H01J/29/48
JP 9-259758 A 10/1997 ..... H01J/9/18

* cited by examiner

*Primary Examiner*—Don Wong
*Assistant Examiner*—Jimmy T. Vu
(74) *Attorney, Agent, or Firm*—Birch, Stewart, Kolasch & Birch, LLP

(57) ABSTRACT

A cathode ray tube has a three-gun type electron gun. The electron gun includes a cathode, a G1 electrode, a G2 electrode aligned in line in this order, the G1 electrode and the G2 electrode having beam-passing holes formed therein. A supporting member supports the cathode in position. A GM electrode is added between the G1 and G2 electrodes and has a beam-passing hole smaller than the holes formed in the G1 electrode and the G2 electrode. The supporting member and the G1 electrode are formed with measurement holes. The G2 electrode may also be formed with a measurement hole therein. A measurement element is inserted through the measurement holes to measure a distance between the G1 electrode and the G2 electrode, and a distance between the GM electrode and the G2 electrode.

3 Claims, 5 Drawing Sheets

ELECTRON GUN FOR CATHODE RAY TUBE

BACKGROUND OF THE INVENTION

1. Field of the Invention

The present invention relates to an electron gun for a cathode ray tube (CRT).

2. Description of the Related Art

FIG. 4 illustrates a conventional electron gun and associated components that form three electrodes, showing a cross-sectional view when the electron gun is cut by a Y-Z plane and seen in an X-direction of FIG. 6.

FIG. 4 illustrates a cathode KG for green, a G1 electrode 1 with a G1 strap 1*a*, a G2 electrode 2, a G3 electrode 3, and a G4 electrode 4 when a measurement element 10 is inserted into the electron gun. Other electrodes following the G4 electrode are not shown. A supporting member 5 formed of hermetic glass firmly holds three cathodes KR, KG, and KB spaced apart predetermined intervals. Another supporting member 6 supports stems that individually supply voltages received from an external electrical circuit to the electrodes. A bead glass 7 securely holds all of the aforementioned components 1*a*, 2, 3, 4, and 6 in place. For example, the measurement element 10 shown in FIG. 4 is used to measure the distance (referred to as $G_{1\text{-}2}$ distance) between the G1 electrode 1 and the G2 electrode 2 and the distance (referred to as $G_{1\text{-}K}$ distance) between the G1 electrode 1 and the cathode KG.

FIG. 5 is a rear view of electron guns of the conventional CRT as seen from a Z-axis of FIG. 6.

Referring to FIG. 5, the conventional CRT has the cathode KR for red, the cathode KG for green, and the cathode KB for blue. The supporting member 5 is formed with holes spaced a predetermined distance apart. The cathodes KR, KG, and KB are inserted into the holes and welded.

The conventional CRT of the aforementioned construction operates as follows:

Each electron beam of the respective electron gun passes through holes formed in the respective electrodes. The holes formed in the respective electrodes are formed progressively large as the electrodes are away from the cathode or are greater than a predetermined size. Electrodes that follow the G1–G4 electrodes are not shown but their beam-passing holes are of the same as or greater than that of the G4 electrode.

In order to achieve highly focussed images, the holes are so designed that the crossover diameter of electron beams is as small as possible. For this purpose, the three electrodes are formed with small diameters to minimize crossover of the electron beams emitted from the cathode. In order to achieve even smaller diameter of electron beams that have subjected to crossover, a focussing electrode is designed to have a beam-passing hole with as large a diameter as possible. The small diameter hole provides a main electronic lens having less lens aberration, suitable for good focussing.

The electron gun of the conventional CRT has beam-passing holes of the aforementioned structure.

The measurement element 10 shown in FIG. 4 will now be described. The assembly accuracy of a cathode determines the cut-off voltage that is an important characteristic of an electron gun used for a CRT. Therefore, the cathode must be assembled with an accuracy of less than several microns.

The electrodes for each electron beam of a conventional CRT have beam-passing holes progressively larger than that of the G1 electrode 1 as the electrodes are away from the cathode. The measurement element 10 is inserted into the beam-passing hole of an electrode farthest away from the cathode with out difficulty. The measurement element 10 is used to measure the $G_{1\text{-}2}$ distance of the CRT. The position of the cathode is calculated based on the $G_{1\text{-}2}$ distance, thereby determining the $G_{1\text{-}K}$ of the CRT. Then, the cathode is welded to the supporting member 5 at a calculated position.

Thus, even if the $G_{1\text{-}2}$ distance is slightly different for red, green, and blue cathodes, the positions of the respective cathodes can be adjusted individually so that the cut-off voltage of the three cathodes can be adjusted to substantially the same value. Further, when the CRT is tested after assembly, the nozzle 10 can be used again to detect defective spaces between the electrodes and the cathode. This prevents detective CRTs from being shipped out.

As described above, the conventional CRT of the aforementioned configuration facilitates insertion of the measurement element 10 to the cathode without difficulty. The configuration allows adjustment of the cut-off voltage of the respective cathodes and test after assembly.

Recently, in order to improve the focussing performance, an electron gun used for a CRT has the G2 electrode having a smaller diameter than the G1 electrode or has an additional electrode (referred to as GM electrode hereinafter) having a small beam-passing hole. However, such a configuration of beam-passing hole does not allow the conventional measurement element to reach the G1 electrode depending on the size of the smallest beam-passing hole, making it difficult to measure the $G_{1\text{-}2}$ distance. This necessitates the assembly of cathode only to an initially designed position. Thus, not only the cut-off voltage is more prone to a change in $G_{1\text{-}2}$ distance but also the electron gun cannot be tested after assembly.

SUMMARY OF THE INVENTION

The present invention was made in view of the aforementioned drawbacks of the conventional CRT.

An object of the invention is to provide an electron gun for use in a CRT that can alleviate defective rate of CRT production while still maintain existing performance and reliability.

A cathode ray tube has a set of three electron guns. Each electron gun includes at least a cathode, a G1 electrode, a G2 electrode aligned in line in this order, the G1 electrode and the G2 electrode having a first and a second hole formed therein, respectively, through which an electron beam emitted from the cathode passes. The electron gun also includes a GM electrode placed between the G1 electrode and the G2 electrode. The GM electrode has a third hole through which the electron beam passes, the third hole being smaller than the first hole and/or the second hole. A supporting member supports the cathode in position. The supporting member and the G1 electrode are formed with a fourth and a fifth hole through which a measurement element is inserted to measure a distance between the G1 electrode and the G2 electrode.

The G2 electrode may be formed with a sixth hole through which the measurement element is inserted to measure a distance between the GM electrode and the G2 electrode.

The fourth to sixth holes are in line with one another.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

The present invention will be described in detail by way of example.

First Embodiment

{Construction}

A high resolution CRT has a set of three electron guns built therein. The three electron guns are of the same structure, each electron gun being operated by an inexpensive integrated circuit to control the flow of electrons.

Figure 1:
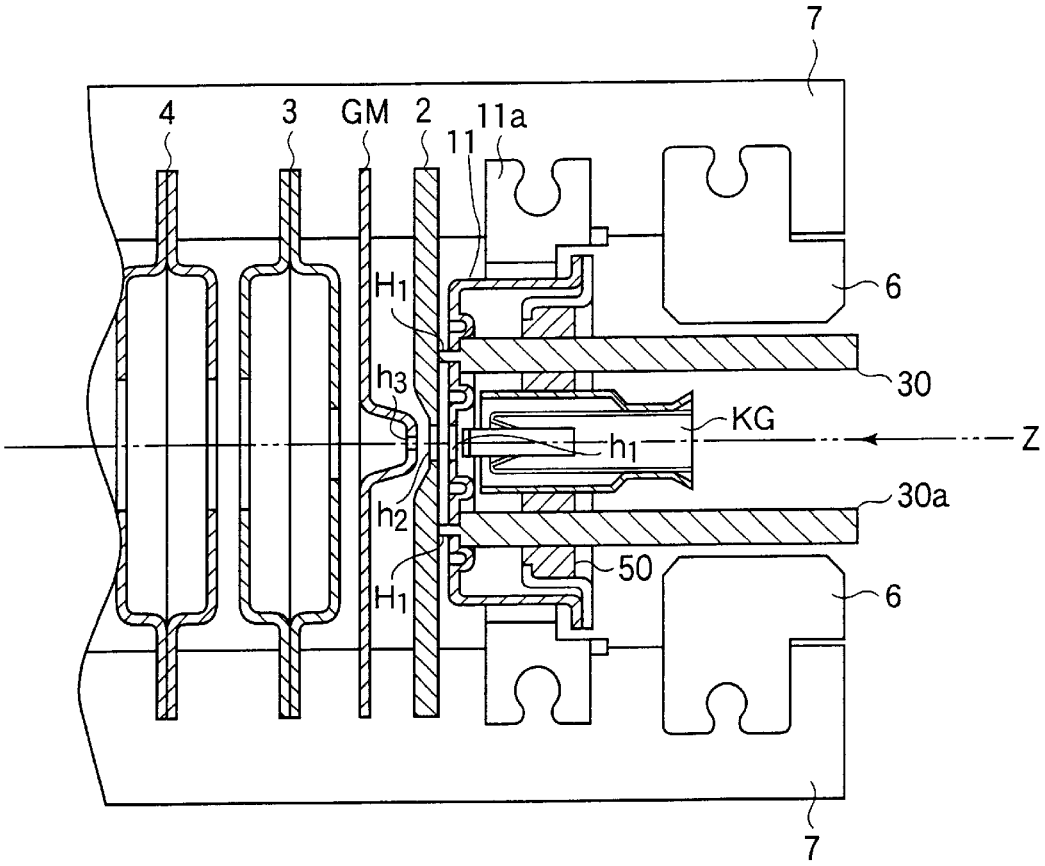
FIG. 1 is a cross-sectional view of a pertinent portion of an electron gun used for a high resolution CRT.
Figure 4:
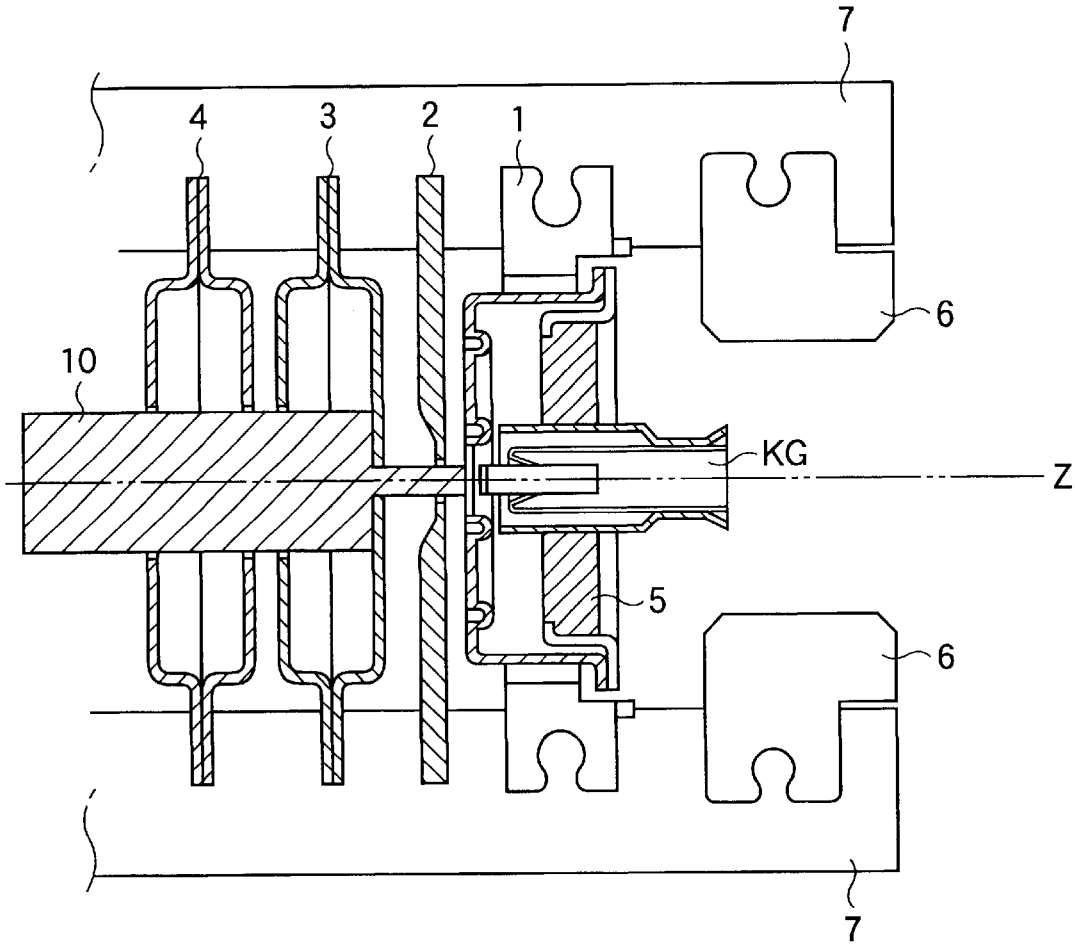
FIG.4 CONVENTIONAL ART
FIG. 4 illustrates a conventional electron gun and associated components.

FIG. 1 is a fragmentary cross-sectional view of a pertinent portion of an electron gun for green, by way of example, taken in the same direction as FIG. 4 when measurement elements 30 and 30*a* are inserted into the electronic gun.

Referring to FIG. 1, the electron gun for green includes a cathode KG, a G1 electrode 11 with a G1 strap 11*a*, a G2 electrode 2, a GM electrode, a G3 electrode 3, and a G4 electrode 4. The G1 electrode 11 and G2 electrode 2 have beam-passing holes h1 (usually, 0.35–0.50 mm in diameter) and h2, respectively, through which an electron beam emitted from the cathode KG passes. The G1 electrode 11 has a diameter of usually 0.35–0.50 mm. The GM electrode is formed with a beam-passing hole h3 that usually has a diameter less than half that of either the beam-passing hole h1 of the G1 electrode 11 or the beam-passing hole h2 of the G2 electrode 2. The electron beam passes through the holes h1, h2, and h3. The G1 electrode has a measurement hole h1 into which a later described measurement element is inserted for measuring a $G_{2-1}$ distance, i.e., the distance between the G1 electrode 11 and the G2 electrode 2. Electrodes beyond the G4 electrode are not shown.

Figure 2:
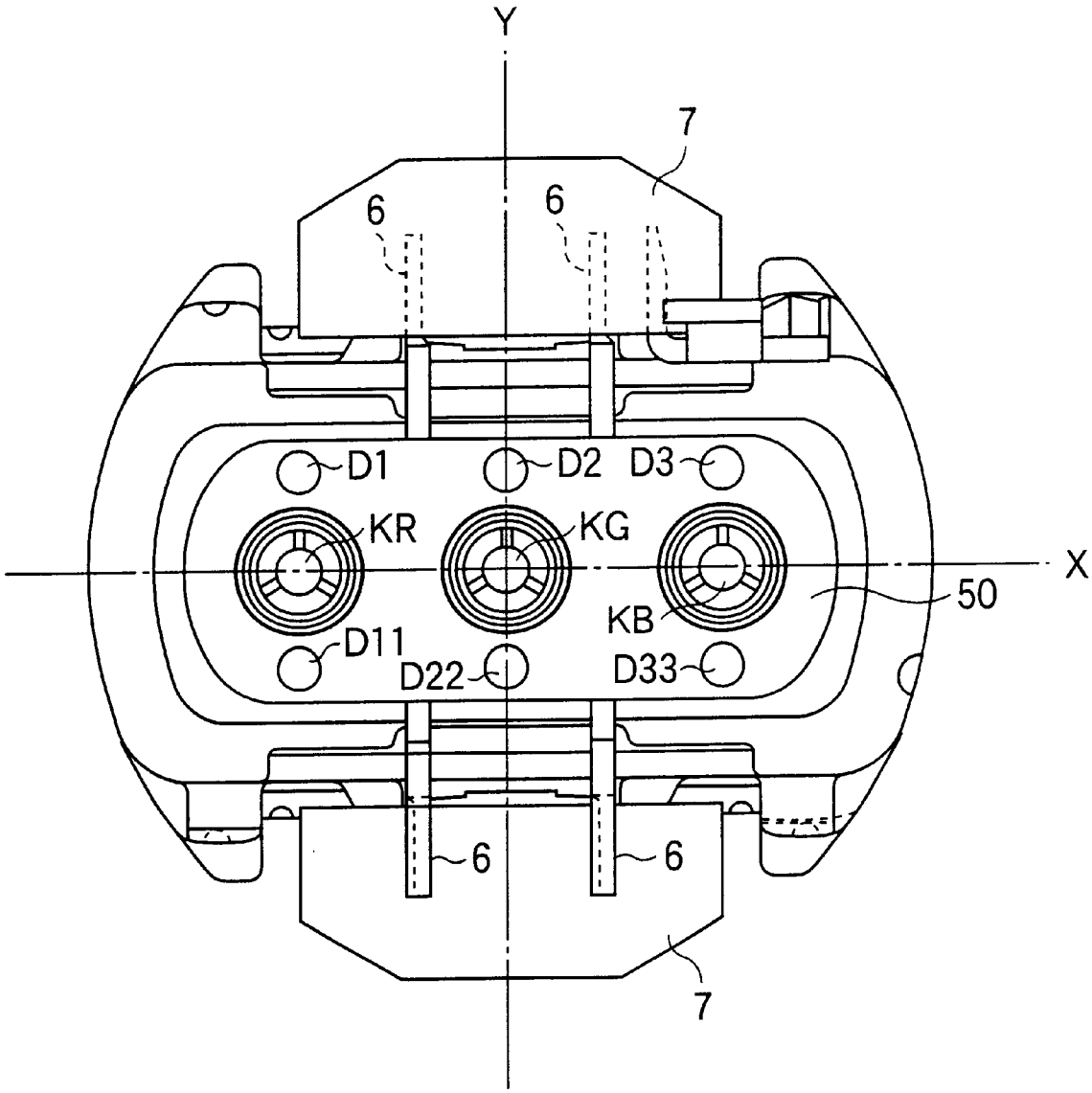
FIG. 2 is a front view of the cathode and the surroundings of the electron gun for the CRT.

FIG. 2 is a front view of the cathode and the surroundings of the electron gun for the CRT.

A supporting member is formed of a hermetic glass 50 and has holes D1–D3 and D11–D33 formed therein, the holes D1–D3 and D11–D33 being used for measuring the $G_{2-1}$ distance. A supporting member 6 supports stems that individually supply voltages from an external electrical circuit to the electrodes. A bead glass member 7 securely holds all of the aforementioned components 11*a,* 2, 3, 4, GM, and 6 in place. Measurement elements 30 and 30*a* (e.g., for green) are inserted into the electron gun through the holes D2 and D22 formed in the supporting member 50, and used to measure the $G_{2-1}$ distance.

{GM Electrode}

The GM electrode will now be described. During the normal operation of the CRT, the cathode KG for green, for example, receives a maximum signal voltage of 100 V, the G2 electrode 2 receives a constant voltage of several hundred volts, and the G3 electrode 3 receives a constant voltage of about several hundred volts. The G1 electrode 11 receives a negative voltage in the range of 0–100 V while the GM electrode receives a voltage that is about 100 V higher than that of the G1 electrode 11.

The G1 electrode 11 and G2 electrode 2 have beam-passing holes with a diameter in the range of 0.3 to 0.4 mm. The G3 electrode 3 has a beam-passing hole with a diameter in the range of 1.0 to 1.5 mm. The GM electrode has a beam-passing hole with a diameter smaller than that of the G1 electrode 11.

This structure allows the GM electrode or the G2 electrode 2 to absorb a part of the flow of electrons emitted from the cathode KG, so that the flow of electrons toward the screen can be efficiently controlled by the low voltage of a cathode-driving power supply.

Referring to FIG. 2, the electron gun has three cathodes arranged horizontally in line: the cathode KR for red, the cathode KG for green, and the cathode KB for blue. The cathodes KR, KG, and KB are spaced apart by predetermined distances in an X-direction. The supporting member 50 is made of hermetic glass and is formed with three sets of vertically aligned holes, i.e., D1 and D11, D2 and D22, and D3 and D33. The supporting member 50 supports cathodes KR, KG, and KB between the two vertically aligned holes D1 and D11, D2 and D22, and D3 and D33, respectively. The holes D1 and D11 are used to measure the $G_{1-2}$ distance for the cathode KR. The holes D2 and D22 are used to measure the $G_{1-2}$ distance for the cathode KG. The holes D3 and D33 are used to measure the $G_{1-2}$ distance for the cathode KB.

{Measurement of $G_{1-2}$ Distance}

The method of measuring the $G_{1-2}$ distance will now be described. For example, as shown in FIG. 1, the respective measurement elements 30 and 30*a* are inserted from the right side of FIG. 1 into the cathode KG. All the measurement elements for the cathodes KR, KG, and KB may be inserted simultaneously. The first embodiment allows the measurement elements 30 and 30*a* to be inserted simultaneously, thereby saving time required for measuring the $G_{1-2}$ distance. The measurement element is slidably received in a longitudinally extending hollow guide, not shown, such that the measurement element can move back and forth in the longitudinal direction. In the present embodiment, a camera is placed by the electron gun to detect the position of tip of the measurement element.

For example, the measurement element is first positioned such that the tip of the measurement element is flush with the surface of the G2 electrode facing the G1 electrode. Then, the measurement element is moved until the tip of the measurement element is flush with the surface of the G1 electrode facing the G2 electrode. The distance over which the measurement element moved is the distance between the G1 electrode and the G2 electrode.

In this manner, the $G_{1-2}$ distances for the cathodes KR, KG, and KB can be measured individually and then the cathodes KR, KG, and KB can be positioned at specific positions, individually, based on the $G_{1-2}$ distance.

Figure 5:
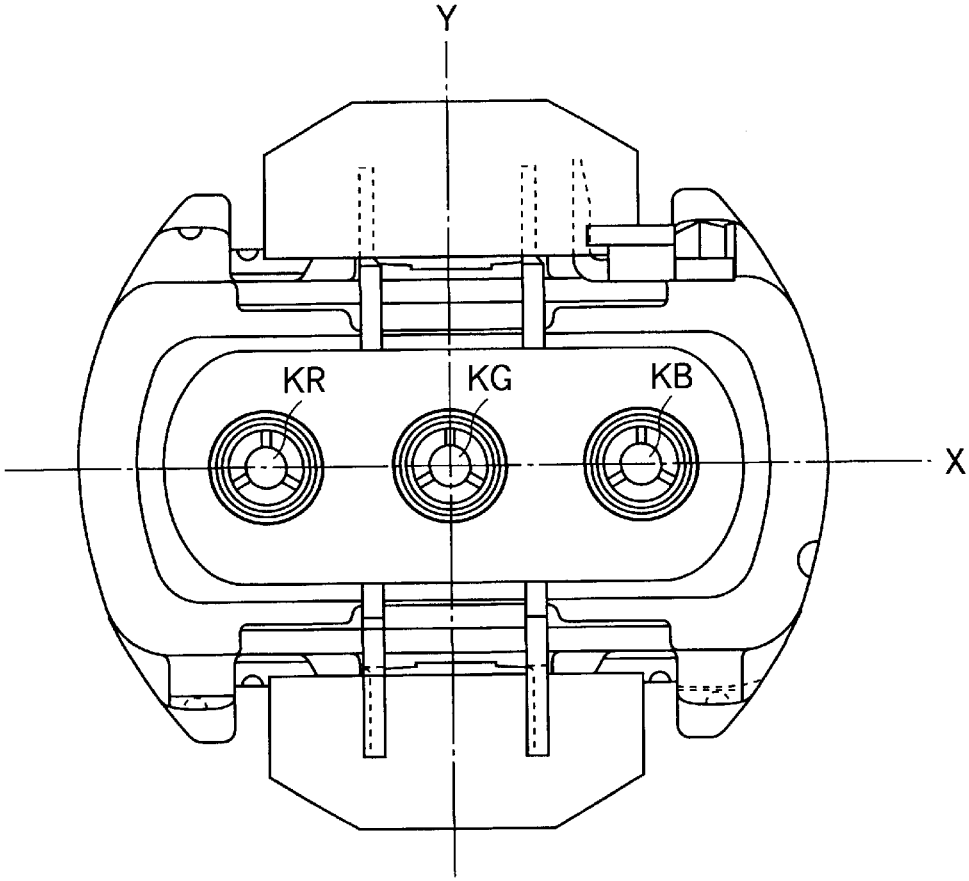
FIG.5 CONVENTIONAL ART
FIG. 5 is a rear view of the electron gun of the conventional CRT.
Figure 6:
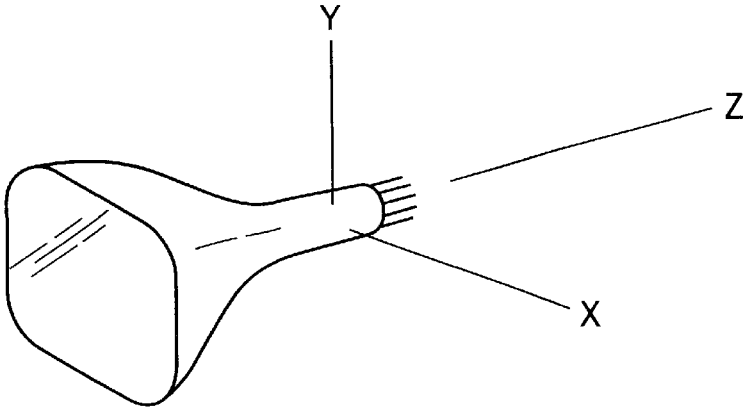
FIG. 6 is a perspective view of a CRT.

The GM electrode has a smaller beam-passing hole than the G1 electrode 1 and G2 electrode 2 that are positioned upstream of the GM electrode with respect to the travel of the electron beam. Thus, if the GM electrode is simply assembled to the electron gun for the conventional CRT of FIG. 5, then the conventional measurement element can not be used to measure the $G_{1-2}$ distance. The structure of an electron gun according to the present invention allows measurement of the $G_{1-2}$ distance even when the additional GM electrode is mounted to the electron gun.

Second Embodiment

Figure 3:
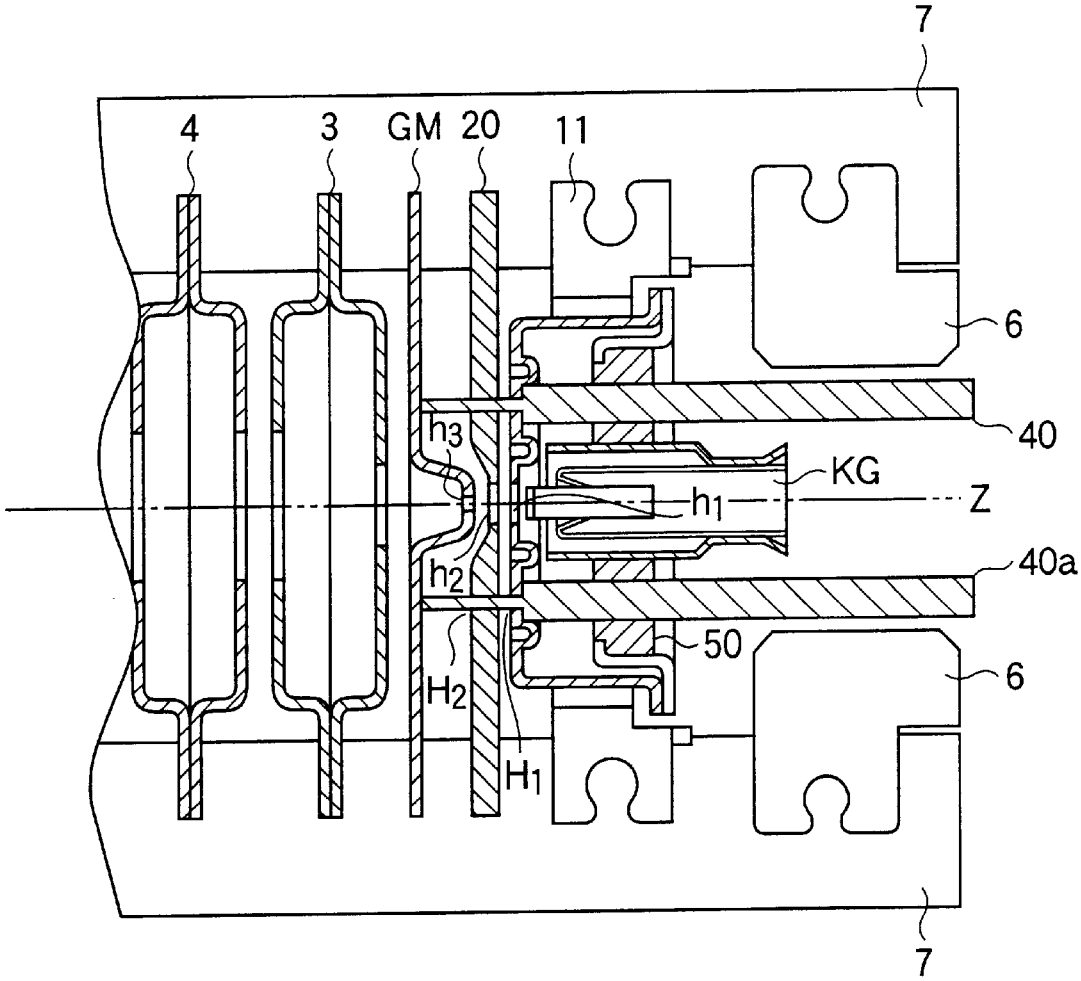
FIG. 3 is a cross-sectional view of an electron gun for a CRT according to a second embodiment.

FIG. 3 is a cross-sectional view of an electron gun for a CRT according to a second embodiment. The second embodiment differs from the first embodiment in that a G2 electrode 20 is formed with holes therein and measurement elements 40 and 40*a* are used to measure the $G_{20\text{-}GM}$ distance between the GM electrode and the G2 electrode 20. The G1 electrode 11 and G2 electrode 20 may have beam-passing holes of the same size or different sizes.

A CRT is usually designed to have well matched cut-off voltages. If the cut-off voltages of three cathodes are not well matched so that the designed cut-off characteristics are not achieved, then the characteristics of the CRT are poor. The cut-off voltage characteristic is determined by the positions of electrodes of the three-electrode section. A small beam-passing hole causes the cut-off voltage characteristic to be susceptible to positional errors of the electrodes.

The second embodiment allows measurement of the $G_{20\text{-}GM}$ distance between the GM electrode and the G2 electrode 20 by the use of measurement elements 40 and 40*a*. This is advantageous in that the inclination of the GM electrode having a small beam-passing hole can be tested. Thus, the second embodiment provides precision adjustment of the distances between electrodes, thereby achieving a good cut-off voltage characteristic, i.e., the three cathodes KR, KG, and KB have well-matched cut-off voltages.

As described above, the electron gun for a high intensity and high focussing performance CRT, used in the G1 electrode and G2 electrode, are formed with holes used for measuring the distances between electrodes. The holes allow smooth insertion of the measurement elements from the cathode side, thereby providing a precise cut-off voltage characteristic at low cost.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An electron gun built in a cathode ray tube, comprising:

a cathode member having three cathodes aligned in a direction substantially perpendicular to a direction in which electron beams travel;

a G1 electrode and a G2 electrode aligned with each of said three cathodes in this order in a direction substantially parallel to the direction in which electron beams travel, said G1 electrode having three first holes formed therein and said G2 electrode having three second holes formed therein such that electron beams emitted from said three cathodes pass through corresponding three first holes and corresponding three second holes;

a GM electrode placed between said G1 electrode and said G2 electrode, said GM electrode having three third holes through which the electron beam passes, the three third holes being smaller than the first holes and/or the second holes; and a supporting member that supports said cathode member in position;

wherein said supporting member has a fourth hole formed therein and said G1 electrode has a fifth hole, the fourth hole and fifth hole receiving a measurement element inserted thereinto to measure a distance between said G1 electrode and said G2 electrode.

2. The electron gun according to claim 1, wherein said G2 electrode has a sixth hole formed therein through which the measurement element is inserted through the fourth and fifth holes to measure a distance between said GM electrode and said G2 electrode.

3. The electron gun according to claim 2, wherein the fourth hole, fifth hole, and sixth hole are in line with one another.

* * * * *